US006770365B2

(12) United States Patent
Yoshimura et al.

(10) Patent No.: US 6,770,365 B2
(45) Date of Patent: Aug. 3, 2004

(54) POLYTRIMETHYLENE TEREPHTHALATE FILAMENT YARN AND PROCESS FOR ITS PRODUCTION

(75) Inventors: Mie Yoshimura, Matsuyama (JP); Koichi Iohara, Matsuyama (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/451,894

(22) PCT Filed: Oct. 30, 2002

(86) PCT No.: PCT/JP02/11316

§ 371 (c)(1),
(2), (4) Date: Apr. 30, 2004

(87) PCT Pub. No.: WO03/038162

PCT Pub. Date: May 8, 2003

(65) Prior Publication Data

US 2004/0076823 A1 Apr. 22, 2004

(30) Foreign Application Priority Data

Oct. 31, 2001 (JP) ..... 2001-334437

(51) Int. Cl.[7] ..... D01F 8/00; D02G 1/20; B32B 25/16; B29C 47/88

(52) U.S. Cl. ..... 428/373; 428/370; 428/374; 428/395; 264/103; 264/172.13; 264/211.14

(58) Field of Search ..... 428/370, 373, 428/374, 395; 264/103, 211.14, 211.13

(56) References Cited

U.S. PATENT DOCUMENTS 4,609,710 A 9/1986 Iohara et al.
6,136,435 A 10/2000 Yoshimura et al.

FOREIGN PATENT DOCUMENTS

WO WO 99/27168 A 6/1999
WO WO 01/66837 A 9/2001

*Primary Examiner*—N Edwards
(74) *Attorney, Agent, or Firm*—Sughrue Mion, PLLC

(57) ABSTRACT

A polytrimethylene terephthalate (PTT) filament yarn capable of being produced by a high speed spinning method and having a high residual elongation and excellent draw-false twisting processability includes 0.5 to 4.0% by mass of filament elongation enhancing agent particles which are drawn-oriented in the filaments along the longitudinal direction thereof and have a thermal deformation temperature of 40° C. or more but less than 105° C., an average particle size D of 0.03 to 0.35 $\mu$m determined in the cross-sections of the filaments and a ratio L/D of the average particle length L in the filament longitudinal direction to the average cross-sectional particle size D of 2 to 20; and the filament yarn exhibits an increase in the residual elongation of 30% or more due to the presence of the filament elongation enhancing agent, a birefringence $\Delta n$ of 0.02 to 0.07, a retaining elongation of 60 to 250% and a thermal stress peak value of 0.18 cN/dtex or less.

12 Claims, No Drawings

POLYTRIMETHYLENE TEREPHTHALATE FILAMENT YARN AND PROCESS FOR ITS PRODUCTION

TECHNICAL FIELD

The present invention relates to polytrimethylene terephthalate filament yarn and to a process for its production. More specifically, the invention relates to polytrimethylene terephthalate filament yarn capable of being produced by high-speed spinning with high productivity, and having high residual elongation as well as excellent draw/false twisting workability, and to a process for its production.

BACKGROUND ART

For melt spinning of polyester filament yarn, maximizing the polymer discharge volume from the spinneret is a very effective means for improving productivity. Recently it has become one of the most preferred strategies in the fiber industry from the standpoint of reducing yarn production costs.

The typical means hitherto employed for improving productivity has been to increase the spinning take-up speed to thereby increase the discharge volume from the spinneret. In this method, however, the high take-up speed results in a higher degree of molecular orientation of the spun fibers such that the obtained spun fibers have lower residual elongation. When this happens, needless to mention, the suitable draw ratio in the subsequent draw/false twisting step is lower, leading to a situation in which the effect of increased discharge volume by the greater take-up speed is offset by the reduced draw factor in the drawing step.

One means of solving this problem is disclosed in Japanese Examined Patent Publication SHO No. 63-32885, as a method in which the addition polymer of an unsaturated monomer is added to a polyester as a filament elongation enhancer, so that the residual elongation of the spun fibers can be increased without offsetting the increased discharge volume. This method is in fact effective for improving residual elongation, for applications involving polyethylene terephthalate fiber as the most common type of polyester fiber. However, when the present inventors attempted to apply this solution means to polytrimethylene terephthalate, it was found that problems unique to polytrimethylene terephthalate occur and prevent polytrimethylene terephthalate filament yarn with high residual elongation and high productivity being obtained. That is, when polytrimethylene terephthalate filament yarn is produced using the filament elongation enhancer described in Japanese Examined Patent Publication SHO No. 63-32885, the filament elongation enhancer simply forms particle-like lumps in the melt spun polymer flow, thereby inhibiting the draft of the spun yarn and often resulting in yarn breakage. Also, it was found that as the molecular orientation unique to polytrimethylene terephthalate increases, the rapidly increasing thermal stress is relaxed and the tightening force on the bobbin increases due to relaxation of the wound filament stress, such that after winding is complete the bobbin cannot be removed from the winder holder and the filament package edges tend to swell, a phenomenon known as bulging. The obtained polytrimethylene terephthalate filament yarn also fails to consistently exhibit satisfactory processability in the draw/false twisting steps which are carried out subsequently.

On the other hand, Japanese Unexamined Patent Publication HEI No. 11-269719 proposes means whereby the residual elongation of spun fibers can be maintained at a conventional level while improving the winding property, which means involves high-speed spinning of polyester filaments containing an added filament elongation enhancer, wherein the filament elongation enhancer used has more limited properties. However, the present inventors found that when the means described in Japanese Unexamined Patent Publication HEI No. 11-269719 is applied for melt spinning of polytrimethylene terephthalate, the filament elongation enhancer fails to adequately exhibit its prescribed function, and it is not possible to avoid frequent yarn breakage during the spun yarn winding, or the swelling of the filament package edges known as bulging. In this case as well, the obtained polytrimethylene terephthalate filament yarn failed to consistently exhibit satisfactory processability in the draw/false twisting steps carried out subsequently.

In recent years, various production techniques and processing techniques have been developed for polytrimethylene terephthalate filament yarn. Among such techniques, one method whose application to polytrimethylene terephthalate has been attempted is known as "co-spinning", wherein two types of polyesters with different melt properties are separately melted and discharged and then simultaneously wound up onto the same filament package to produce polyester composite yarn comprising two types of undrawn yarn with different properties.

However, when polytrimethylene terephthalate fiber is subjected to co-spinning with a polyester fiber such as polyethylene terephthalate at a spinning speed of, for example, 3000 m/min or greater, as the thermal stress due to the elastic recovery characteristic of the polytrimethylene terephthalate is higher than that of other polyesters, wind-up stress is produced on the polytrimethylene terephthalate fibers during winding, while the other polyester lacks winding tension due to weaker elastic recovery, such that sagging of the other polyester fibers in relation to the polytrimethylene terephthalate fibers occurs. It is difficult to evenly wind two running fiber groups, in such a state, onto the same package simultaneously.

For spinning of polytrimethylene terephthalate fibers or co-spinning thereof with polyester fibers other than polytrimethylene terephthalate in the relatively low spinning speed range of 1,000 to 1,500 m/min, both have a low level of thermal stress, and therefore the difference in stress relaxation is not significant and simultaneously winding of the two can be accomplished. However, as the glass transition temperature (Tg) of polytrimethylene terephthalate is close to room temperature, at 30 to 40° C., the properties of the composite yarn undergo alteration, within a few hours on several days, resulting in frequent yarn breakage during the draw/false twisting steps, and producing a poor-quality drawn/false twisted yarn product that exhibits considerable fluff or dye spots. In addition, because of the excessively low degree of orientation of the composite yarn, fused yarn breakage and incomplete untwisting tend to be problems in the draw/false twisting heater, and stable false twisting cannot be accomplished for this reason.

Thus, the prior art has included no knowledge of polytrimethylene terephthalate filament yarn produced by high-speed spinning, wherein the polytrimethylene terephthalate filament yarn has excellent draw/false twisting properties, and exhibits high residual elongation and high productivity, or of a process for its production.

DISCLOSURE OF THE INVENTION

It is an object of the present invention to provide polytrimethylene terephthalate filament yarn obtained by high-speed spinning, which exhibits high productivity, high residual elongation, and excellent suitability for filament processing such as draw/false twist working, as well as a process for its production.

Upon much diligent research directed toward solving the problems explained above, the present inventors have found that when a filament elongation enhancer with a specific heat deformation temperature is used, it ceases to function as a stress concentrator and instead exhibits a function as a spinning stress carrier for the spun filaments, and as a result, the filament elongation enhancer becomes oriented along the fiber axis direction and finely dispersed in the fibers when they are drawn, thereby lowering the thermal stress and allowing release of tightening tension and improvement in residual elongation to be simultaneously achieved.

The polytrimethylene terephthalate filament yarn of the present invention comprises polytrimethylene terephthalate filaments from which a filament yarn is formed, and a filament elongation enhancing agent particles dispersed and contained in the filaments, in a content of 0.5 to 4.0% by mass based on the mass of the filaments, and in the filament yarn, the filament elongation enhancing agent particles in the polytrimethylene terephthalate filaments satisfies the requirements (a), (b) and (c):

(a) the filament elongation enhancing agent particles has a thermal deformation temperature (T) of 40° C. or more and less than 105° C.;

(b) in cross-sectional profiles of the filaments, the filament elongation enhancing agent particles have an average particle size (D) of 0.03 to 0.35 μm; and (c) the filament elongation enhancing agent particles are drawn and oriented in the filaments along the longitudinal direction thereof and have a ratio (L/D) of the average particle length (L) of the drawn and oriented particles to the average cross-sectional size (D) of the particles of 2 to 20, and the filament yarn satisfies the requirements (d), (e), (f) and (g):

(d) the filament yarn exhibits an increase (I%) in residual elongation thereof of 30% or more, determined in accordance with the equation defining the I(%):

$$I(\%)=(El_b(\%)/El_o(\%)-1)\times 100$$

in which equation, $El_b(\%)$ represents a residual elongation of the filament yarn and $El_o$ represents a residual elongation of a comparative polytrimethylene terephthalate filament yarn prepared by the same filament yarn-producing procedures as those of the filament yarn as mentioned above, except that no filament elongation enhancing agent particles are contained in the comparative filament yarn;

(e) the filament yarn exhibits a birefringence Δn of 0.02 to 0.07;

(f) the filament yarn exhibits a retaining elongation of 60 to 250%; and (g) the filament yarn exhibits a peak value in thermal stress thereof of 0.18 cN/dtex or less.

In the polytrimethylene terephthalate filament yarn of the present invention, the thermal deformation temperature (T) of the filament elongation enhancing agent particles is preferably in the range of from 60° C. to 95° C.

In the polytrimethylene terephthalate filament yarn of the present invention, the filament elongation enhancing agent particles preferably comprises an addition-polymerization product of at least one ethylenically unsaturated monomer which product is substantially incompatible with polytrimethylene terephthalate and has an weight average molecular weight of 2,000 or more.

In the polytrimethylene terephthalate filament yarn of the present invention, the addition polymerization product for the filament elongation enhancing agent particles is preferably selected from the group consisting of polymethyl metacrylate polymers comprising, as at least a principal component, methyl metacrylate and isotactic polystyrene polymers comprising, as at least a principal component, styrene, and has a weight average molecular weight of 8,000 to 200,000 and a melt index A of 10 to 30 g/10 minutes determined at a temperature of 230° C. under a load of 37.3N (3.8 kgf).

In the polytrimethylene terephthalate filament yarn of the present invention, the addition polymerization product for the filament elongation enhancing agent particles is preferably selected from syndioctatic polystyrene polymers comprising, as at least a principal component, styrene, and has a weight average molecular weight of 8,000 to 200,000 and a melt index B of 6 to 50 g/10 minutes determined at a temperature at 300° C. under a load of 21.2N (2.16 kgf).

In the polytrimethylene terephthalate filament yarn of the present invention, the addition polymerization product for the filament elongation enhancing agent particles is preferably selected from polymethylpentene polymers comprising as at least a principal component, methylpentene-1, and has a weight average molecular weight of 8,000 to 200,000 and a melt index C of 26 to 20 g/10 minutes determined at a temperature of 260° C. under a load of 49.0N (5.0 kgf).

The polytrimethylene terephthalate filament yarn of the present invention optionally further comprises polyester filaments containing substantially no filament elongation enhancing agent particles and mixed into the polytrimethylene terephthalate filaments.

In the polytrimethylene terephthalate filament yarn of the present invention, the polyester filaments containing substantially no filament elongation enhancing agent particles preferably comprise a polyester selected from the group consisting of trimethylene terephthalate, polyethylene terephthalate, polybutylene terephthalate, poly-1,4-cyclohexanedimethylene terephthalate, and polyethylene-2,6-naphthalenedicarboxylate.

The process for producing a polytrimethylene terephthalate yarn of the present invention comprises:

mixing a polytrimethylene terephthalate resin with a filament elongation enhancing agent particles having a thermal deformation temperature of 40 to 105° C. in an amount of 0.5 to 4.0% by mass based on the mass of the resin;

melting the resultant resin mixture, extruding the melt through a melt-spinneret into the form of filaments, cool-solidifying the extruded filamentary melt streams under draft along a melt-spinning line, and winding up the solidified filaments at a speed of 2,000 to 8,000 m/min, and in the process, the melt of the resin mixture is passed through a filter arranged right above the melt spinneret in the melt spinning line and having a pore size of 40 μm or less;

and the melt-spinning draft is controlled in the range of from 150 to 800.

In the process for producing a polytrimethylene terephthalate yarn of the present invention, the temperature of the melt spinneret is preferably controlled in the range of from 240 to 270° C., the cool-solidifying is effected by blowing cooling air toward the extruded filamentary melt streams at a blow speed of 0.1 to 0.4 m/second, and the winding is effected under a winding tension of 0.035 to 0.088 cN/dtex.

The process for producing a polytrimethylene terephthalate yarn of the present invention optionally further comprises, in the melt-extruding procedures, co-melt extruding the polytrimethylene terephthalate resin containing the filament elongation enhancing agent particles and a polyester resin containing substantially no filament elongation enhancing agent particles in accordance with a co-melt spinning method through one and the same spinneret or two spinnerets different from each other; and in the winding procedure, combining the resultant polytrimethylene terephthalate filaments with the co-melt spun polyester filaments while the combined filament yarn is wound at a speed of 2,000 to 8,000 m/second.

In the process for producing a polytrimethylene terephthalate yarn of the present invention, the polyester filaments containing substantially no filament elongation enhancing agent particles preferably comprise a polyester selected from the group consisting of trimethylene terephthalate, polyethylene terephthalate, polybutylene terephthalate, poly-1,4-cyclohexanedimethylene terephthalate, and polyethylene-2,6-naphthalenedicarboxylate.

BEST MODE FOR CARRYING OUT THE INVENTION

According to the invention, "polytrimethylene terephthalate" encompasses polyesters which comprise a trimethylene terephthalate unit as the main repeating unit and, so long as the purpose of the invention is not hindered, it may be a polyester copolymerized with a third component at, for example, up to 15 mole percent and preferably no greater than 5 mole percent with respect to the total moles of the acid component.

As preferred examples of such third components there may be used acid components such as isophthalic acid, succinic acid, adipic acid, 2,6-naphthalenedicarboxylic acid and metal sulfoisophthalic acids, or glycol components such as 1,4-butanediol, 1,6-hexanediol, cyclohexanediol and cyclohexanedimethanol. The intrinsic viscosity of the polytrimethylene terephthalate used for the invention (as measured at a temperature of 35° C. using o-chlorophenol as the solvent) is preferably in the range of 0.5–1.8.

The polytrimethylene terephthalate filament yarn of the invention may, if necessary, contain various additives such as, for example, delustering agents, thermal stabilizers, defoaming agents, color adjustors, flame retardants, antioxidants, ultraviolet absorbers, infrared absorbers, fluorescent whiteners, coloring pigments, and the like.

According to the invention, the filament yarn comprising polytrimethylene terephthalate is imparted with high residual elongation and excellent draw/false twisting workability by dispersion of a filament elongation enhancer into the polytrimethylene terephthalate. The filament elongation enhancer is substantially non-compatible with the polytrimethylene terephthalate and forms an island/sea pattern in the polytrimethylene terephthalate, or in other words, the polytrimethylene terephthalate acts as the matrix forming the "sea" component while the filament elongation enhancer particles form the "island" components dispersed in the sea component, and this dispersed melt is discharged as the filament stream from the spinneret opening. When the filament stream of the polymer melt passes through the cooling and thinning process at a prescribed winding speed in the spinning line, the filament elongation enhancer particles which are dispersed in an island fashion are converted from a molten state to a glass state before the polytrimethylene terephthalate, and this is important in that it acts to essentially halt the thinning process of the polytrimethylene terephthalate melt. Such action of restraining thinning will result in completion of thinning of the polytrimethylene terephthalate melt at a higher temperature than if no elongation enhancer particles are included, and with its own elongation viscosity in a lower state. That is, the point at which thinning of the polytrimethylene terephthalate melt itself is completed, i.e. the point at which it reaches the same speed as the prescribed winding speed, is closer to the spinneret than in a system where no filament elongation enhancer is added, and therefore thinning of the polytrimethylene terephthalate melt is promoted by the filament elongation enhancer in the upstream zone of the melt spinning line near the spinneret. As a result, the spinning stress required for the speed to reach the winding speed, with respect to the discharged filament stream, is lower than in a system without addition of a fiber elongation enhancer. Consequently, the polymer of the obtained filaments has a lower degree of orientation, and the breaking elongation of the filaments increases.

The elongation of the polytrimethylene terephthalate filament yarn obtained by this action of the filament elongation enhancer is assumed to increase, but according to the invention, the filament elongation enhancer particles must satisfy the following condition (a) in the polytrimethylene terephthalate filaments. Namely, the filament elongation enhancer particles must have a thermal deformation temperature (T) of 40–105° C. In order for the filament elongation enhancer particles to exhibit an effect of promoting thinning of the discharged filamentous polymer stream under the spinning stress, the filament elongation enhancer particles must convert from the molten state to a glass state more rapidly than the matrix polymer in the discharged polymer stream. It is therefore essential for the thermal deformation temperature of the filament elongation enhancer particles to be higher than the thermal deformation temperature (glass transition temperature) of the polytrimethylene terephthalate. If the thermal deformation temperature is less than 45° C., then it will be difficult for thinning of the filament elongation enhancer particles to be completed more rapidly than the polytrimethylene terephthalate. On the other hand, if the thermal deformation temperature is greater than 105° C., the difference between that and the thermal deformation temperature of polytrimethylene terephthalate exceeds 65° C., such that the effect of promoting thinning is over-expressed and elongation of the filament elongation enhancer particles by the spinning draft is not adequately expressed, resulting in solidification of massive particles at the upstream section of the spinning line. These act substantially as foreign matter in the polymer melt stream and lead to interruption of the thinned polymer stream, thus inhibiting stable spinning. A more preferred range for the thermal deformation temperature of the filament elongation enhancer particles used for the invention is 60 to 95° C.

In order for the filament elongation enhancer to function as a stress concentrator in the spun polymer melt stream and exhibit an effect of enhancing the filament elongation in the polytrimethylene terephthalate filament yarn of the invention, it must be dispersed in fine particulate form in the obtained filament yarn, and condition (b), i.e. a mean particle size (D) of 0.03 to 0.35 $\mu$m in a cross-section of the filament, must be satisfied. If the mean particle size is smaller than 0.03 μm, the size will not be sufficiently large to function as a stress concentrator and, therefore, not only will the residual elongation improving effect be inadequate, but the reduction in thermal stress will also be inadequate, deposition will occur on the fiber surfaces forming a rough irregular condition and the frictional coefficient of the fiber surface will be reduced, such that winding will become difficult. On the other hand, if the mean size exceeds 0.35 μm, uneven stress is concentrated locally in the fiber cross-sections, resulting in unbalanced distribution of the spinning tension which not only tends to create rotation in the spun fibers, but also disrupts the flow of the polymer melt due to uneven melt viscosity or shear stress force in each of the discharge openings, making it impossible to achieve stable spinning. A more preferred range for the mean particle size of the filament elongation enhancer particles is 0.07 to 0.25 μm.

In order for the filament elongation enhancer used for the invention to function as a suitable stress concentrator for the discharged filamentous polymer stream in the spinning step, it is necessary for it to be oriented along the lengthwise direction of the obtained filament and to exist in an elongated state, and for the ratio of the mean particle length (L) and the cross-sectional mean particle size (D) (L/D) to be 2–20 as condition (c). A L/D ratio of greater than 20 means that the filament elongation enhancer has followed the deformation of the polytrimethylene terephthalate under the spinning stress, resulting in insufficient improvement in residual elongation and reduction in thermal stress through the effect of promoting thinning of the polytrimethylene terephthalate melt. On the other hand, if the L/D ratio is less than 2, the effect as a stress concentrator and thinning promoter in the filamentous polymer melt stream will be over-exhibited, such that its effect as foreign matter will be dominant, preventing stable spinning. The preferred range for the L/D ratio is 5–15.

As a preferred filament elongation enhancer for the invention there may be used an addition polymer of at least one type of ethylenic unsaturated monomer which is essentially incompatible with polytrimethylene terephthalate. Specifically there may be mentioned acrylonitrile-styrene copolymer, acrylonitrile-butadiene-styrene copolymer, polystyrene, polypropylene, polymethylpentene, polyacrylate, polymethyl methacrylate and their copolymers with third components.

As a stress concentrator, the unsaturated monomer addition polymer must exhibit structural viscosity as a polymer component independently of the polytrimethylene terephthalate, and therefore the weight-average molecular weight of the filament elongation enhancer is preferably 2,000 or greater, and more preferably 2,000 to 200,000. If the weight-average molecular weight is less than 2,000, i.e. an oligomeric low molecular weight, it will be more difficult to exhibit structural viscosity as a polymer component and, therefore, the transition from molten state to glass state will not be distinct, the effect as a stress concentrator and thinning promoter will be inadequate, and the effect of reduced thermal stress will also be inadequate. On the other hand, if the weight-average molecular weight exceeds 200,000, the cohesive energy of the polymer increases dramatically and results in much higher melt viscosity compared to the polyester, thus making dispersion into the polyester melt exceedingly difficult. As a result, the spinnability of the obtained polyester melt is reduced and the effect as foreign matter in the polytrimethylene terephthalate increases, such that it becomes difficult to obtain filament yarn or its processed product having properties which are practical for the subsequent steps. The range of 5000–120,000 for the weight-average molecular weight of the filament elongation enhancer is even more preferred. Such a polymer component is more preferable for the invention since it will generally exhibit improved heat resistance as well.

Of such filament elongation enhancing addition polymers there are preferred for use polymethyl methacrylate-based copolymers or isotactic polystyrene-based copolymers composed mainly of styrene, having a weight-average molecular weight of 8,000 to 200,000 and a melt index A (ASTM-D1238, temperature: 230° C., load: 3.8 kgf) of 10–30 g/10 min; syndiotactic polystyrene-based polymers (crystalline) having a weight-average molecular weight of 8,000 to 200,000 and a melt index B (ASTM-D1238, temperature: 300° C., load: 2.16 kgf) of 6–50 g/10 min; and polymethylpentene-based polymers having a weight-average molecular weight of 8,000–200,000 and a melt index C (ASTM-D1238, temperature: 260° C., load: 5.0 kgf) of 26–200 g/10 min. Such polymers have excellent thermal stability and dispersed stability at the spinning temperature of polyesters, and are therefore preferred for the invention.

The aforementioned filament elongation enhancer is added and dispersed in the polytrimethylene terephthalate in the range of 0.5 to 4.0 wt % and preferably 1.0 to 3.0 wt %. If the filament elongation enhancer is dispersed at less than 0.5 wt %, it will not achieve the dispersion required to function as a stress concentrator in the filamentous polymer stream during the spinning step, and therefore the effect of improving the residual elongation with respect to the obtained filament yarn will be insufficient and the reduction in thermal stress will also be inadequate. On the other hand, if it exceeds 4.0 wt %, stress concentration will occur unevenly in local portions of the lateral cross-section of the filamentous polymer stream during the spinning step, resulting in unbalanced distribution of the spinning tension which will not only tend to induce rotation in the spun fibers, but may also produce a non-uniform mixture state which will cause flow disruption due to uneven melt viscosity and/or shear stress force in the discharge openings, making stable spinning impossible to achieve.

The polytrimethylene terephthalate filament yarn of the invention, in addition to satisfying the conditions (a), (b) and (c) mentioned above, must also have (d) a residual elongation increase (I%) of at least 30% and preferably at least 50%, (e) a birefringence Δn of 0.02 to 0.07 and preferably 0.03 to 0.06, (f) a residual elongation of 60 to 250% and preferably 120 to 200%, and (g) a thermal stress peak value of no greater than 0.18 cN/dtex and preferably no greater than 0.15 cN/dtex.

The residual elongation increase (I%) of condition (d) is the increase in the residual elongation of polytrimethylene terephthalate filament yarn containing a filament elongation enhancer with respect to the residual elongation of polytrimethylene terephthalate filament yarn containing no filament elongation enhancer.

The residual elongation increase (I%) of filament yarn is defined by the following equation.

$$I(\%)=(EL_b(\%)/EL_o(\%)-1)\times 100$$

(where $EL_b(\%)$ represents the residual elongation of the filament yarn and $EL_o(\%)$ represents the residual elongation of comparative polytrimethylene terephthalate filament yarn obtained under the same spinning conditions as the first filament yarn except for containing no filament elongation enhancer.)

The residual elongation of the filament yarn is correlated with the draw ratio for drawing, and is therefore related to the productivity.

That is, the filament yarn productivity may be judged based on the draw ratio increase (J%) expressed by the following equation.

$$J\%=(DR_b/DR_o-1)\times 100$$

(where $DR_b$ represents the maximum draw ratio of the polytrimethylene terephthalate filament yarn of the invention, and $DR_o$ represents the maximum draw ratio of the polytrimethylene terephthalate filament yarn obtained under the same spinning conditions except for containing no filament elongation enhancer.)

Consequently, the polymer discharge flow (productivity) Q for melt spinning of polytrimethylene terephthalate may be expressed by the following equation:

$$Q=(D/10{,}000)\times V\times DR$$

where the fineness after drawing of the obtained filament is represented by D (dtex), the spinning take-up speed is represented by V (m/min) and the draw ratio in the drawing step is represented by DR and, at a given spinning speed, a higher draw ratio increase (J%) indicates increased productivity (discharge flow Q). Consequently, if the residual elongation increase (I%) is higher, the correlated draw ratio increase (J%), and therefore the productivity Q, will also be higher.

If the residual elongation increase (I%) is less than 30% the draw ratio increase (J%) is also less than 30%, in which case the productivity cannot be deemed to be significantly improved from an industrial viewpoint. If the residual elongation increase (I%) of the polytrimethylene terephthalate filament yarn is 50% or greater, the productivity improvement will be a level preferred as suitable for industrial application.

As regards condition (e) of the invention, with a filament yarn birefringence Δn of less than 0.02, the obtained polytrimethylene terephthalate will have a glass transition temperature of 40° C. or below, which is relatively low, and therefore the properties will tend to be altered and the drawability impaired with time, while frequent yarn breakage will tend to occur during the draw/false twisting step, and false twisted yarn obtained from the filament yarn will tend to exhibit fluff or dye spots. On the other hand, with a Δn of greater than 0.07, the obtained filament yarn will have low residual elongation and, therefore, the obtainable draw factor will approach 1, resulting in a drastically narrowed degree of freedom in setting the conditions for draw/false twisting and making it difficult to produce polytrimethylene terephthalate fiber with versatile properties.

As regards condition (f) of the invention, if the residual elongation of the filament yarn is less than 60%, the elastic recovery and thermal stress of the filament yarn at room temperature increase dramatically, such that even if the wind-up tension is set to a very low level during spinning, the problem occurs that the bobbin cannot be removed from the winder holder. In addition, the filament package edges tend to swell (bulging), creating a difficulty in use in the draw/false twisting step. On the other hand, if the residual elongation of the filament yarn is greater than 250%, the fiber structure of the polytrimethylene terephthalate filament yarn fails to be adequately anchored, such that the properties tend to be altered and the drawability impaired with time, while often frequent yarn breakage occurs during the draw/false twisting step and the obtained false twisted yarn exhibits fluff or dye spots.

As regards condition (g) of the invention, if the thermal stress peak value of the filament yarn exceeds 0.18 cN/dtex, it will undergo a very high degree of stress relaxation in the spinning wind-up step, such that after completion of winding, the bobbin sometimes cannot be removed from the winder holder, the edges of the wound filament package swell (bulging), and it becomes difficult to use the product in the draw/false twisting step.

The polytrimethylene terephthalate filament yarn of the invention described above may be produced by the following process, for example.

Specifically, the filament elongation enhancer particles are mixed and dispersed at 0.5 to 4.0 wt % and preferably 1.0 to 3.0 wt % in a polytrimethylene terephthalate resin, the obtained polytrimethylene terephthalate/filament elongation enhancer particle mixture is melted and extruded and spun as a filament from a spinneret, at which time a filter with a pore size of no greater than 40 μm and preferably no greater than 25 μm is set directly above the spinneret, the melt of the mixture is passed through it, the spinning draft is adjusted within a range of 150 to 800 and preferably 250 to 600, and the filament is taken up at a take-up speed of 2,000 to 8,000 m/min and more preferably 2,000 to 6,000 m/min, and wound up. Here, the spinning draft is defined by the following equation.

Spinning draft=spinning take-up speed (m/min)/average moving speed of polymer at discharge surface (m/min)

Using a filter with a pore size of greater than 40 μm for the process of the invention results in inclusion of coarse particles in the discharged polymer stream making it difficult to stably maintain smooth spinning, while bleed-out of the coarse particles on the fiber surfaces produces irregularities on the surface of the resulting filament, thus hampering spinning and winding up.

According to the process of the invention, a spinning draft of less than 150 will necessarily require using a spinneret with a small discharge aperture, such that the polymer stream passing through it will be subjected to high shear stress in the fiber axis direction, and therefore the filament elongation enhancer particles dispersed in the polymer stream are stretched out in the fiber axis direction, and snapped off to a mean particle size (D) of less than 0.03 μm; the residual elongation improving effect and low thermal stress of the spun yarn are therefore inhibited. On the other hand, with a high draft exceeding 800, the discharge aperture is increased and the effect of snapping by shear stress in the discharge opening is reduced, but an irregularity produced on the filament surface due to bleed out of the crude filament elongation enhancer particles into the fiber surfaces renders it difficult to wind up the spun filament.

According to the process of the invention, a spinning take-up speed of less than 2,000 m/min will not give polytrimethylene terephthalate filament yarn with a birefringence (Δn) of 0.02 or greater. On the other hand, a spinning take-up speed of greater than 8,000 m/min will produce polytrimethylene terephthalate filament yarn with a birefringence (Δn) exceeding 0.07.

According to the process of the invention, for melting and discharge of polytrimethylene terephthalate with a filament elongation enhancer added at 0.5 to 4.0 wt % and preferably 1.0 to 3.0 wt %, the spinneret temperature is set to 240 to 270° C. and preferably 245 to 260° C., the cooling air speed on the discharged filamentous polymer stream downstream from the spinneret is set to 0.1 to 0.4 m/sec and preferably 0.2 to 0.3 m/sec, for cooling and solidification of the filamentous polymer stream, and the obtained filament is preferably wound up under a winding tension adjusted in the range of 0.035 to 0.088 cN/dtex and preferably 0.040 to 0.070 cN/dtex.

If the spinneret temperature is below 240° C., the melting of the polytrimethylene terephthalate itself will be insufficient, and the temperature may be below the molding temperature of the filament elongation enhancer particles mixed therewith, depending on their type, in either of which cases the polymer melt will exhibit insufficient spinnability and frequent spun yarn breakage will tend to occur. On the other hand, if the spinneret temperature is above 270° C., thermal deterioration of the addition polymer in the filament elongation enhancer particles, and of the polytrimethylene terephthalate, may occur.

For cooling of the molten polymer stream, it is usually preferred to use an ordinary sideways air blower. Maintaining the cooling air speed in the range of 0.1 to 0.4 m/sec will effectively improve the residual elongation and reduce the thermal stress for the obtained filament yarn. If the cooling air speed is less than 0.1 m/sec, the obtained spun filament yarn becomes more uneven in the fiber axis direction, often making it difficult to obtain high quality false twisted yarn in the subsequent steps. On the other hand, if the cooling air speed is greater than 0.4 m/sec, the polymer melt stream is excessively cooled, such that the elongation viscosity increases and the residual elongation increase range is sometimes reduced.

If the spun yarn winding tension is set to less than 0.035 cN/dtex, traverse printing property for the bobbin becomes insufficient, often causing problems for package formation such as cob-webbing or irregular yarn-guiding. On the other hand, if the spun yarn winding tension is set to exceed 0.088 cN/dtex, stretch recovery is exhibited as a property unique to polytrimethylene terephthalate, such that winding tightness occurs to cancel the generated elongation stress, thereby producing a problem in removal of the package.

An appropriate method may be selected for addition of the filament elongation enhancer particles to the polytrimethylene terephthalate. For example, the filament elongation enhancer particles may be combined at the final stage of the polytrimethylene terephthalate polymerization step, or the polytrimethylene terephthalate resin and the filament elongation enhancer particles may be melted and combined together, extruded and cooled, cut and made into chips. Alternatively, a side introduction port may be provided in the polytrimethylene terephthalate melt spinning apparatus, and the filament elongation enhancer introduced through the introduction port in a molten state into the polytrimethylene terephthalate melt by dynamic and/or static mixture. As an alternative method, the polymer may be introduced in a molten state into a polyester melt spinning apparatus through a side introduction port by either dynamic or static mixture, and then combined with the filament elongation enhancer melt. Both may instead be mixed in chip form and dried, and then supplied for melt spinning. A portion of the polymer may also be drawn from the polytrimethylene terephthalate supply line of a continuous polymer spinning direct line, and used as the matrix for kneaded dispersion of the filament elongation enhancer particles therein, after which the dispersion may be transported to the polymer supply line with dynamic and/or static mixture as desired, for mixture with the polymer, and the mixture distributed to conduits connected to respective spinnerets.

The melt spinning mode described above may be applied not only for production of the filament yarn of the invention alone, but also production of other types of filament yarn. For example, polytrimethylene terephthalate resin containing a filament elongation enhancer and a polyester other than polytrimethylene terephthalate containing substantially no filament elongation enhancer may be discharged from separate discharge openings and the filament yarn doubled and simultaneously wound up on the same filament package to obtain polyester composite yarn as a blend of two undrawn yarn types with different properties.

That is, according to the process of the invention, a polytrimethylene terephthalate resin containing a particulate filament elongation enhancer dispersed therein at 0.5 to 4.0 wt % and preferably 1.0 to 3.0 wt % with respect to polytrimethylene terephthalate may be melt spun with a different type of polyester resin containing substantially no filament elongation enhancer by co-spinning, and taken up at a take-up speed of 2,000 to 8,000 m/min to obtain the polyester composite yarn.

Here, co-spinning is a method commonly used in melt spinning, wherein two polymer types with different melt properties are each melted separately, and each melt is discharged from a separate spinneret or else both melts are discharged from a composite spinneret, and then cooled and hardened, after which the obtained filaments are simultaneously wound up as a single filament package.

As the different type of polyester containing substantially no filament elongation enhancer for the co-spinning method, it is preferred to use at least one type selected from among polytrimethylene terephthalate resins containing 90 mole percent or greater of a trimethylene terephthalate repeating unit, polyethylene terephthalate resins containing 90 mole percent or greater of an ethylene terephthalate repeating unit, polybutylene terephthalate resins containing 90 mole percent or greater of a butylene terephthalate repeating unit, polycyclohexanedimethylene terephthalate resins containing 90 mole percent or greater of a cyclohexanedimethylene terephthalate repeating unit, and polyethylene-2,3-naphthalate resins containing 90 mole percent or greater of an ethylene-2,6-naphthalate repeating unit.

When one of the above-mentioned polytrimethylene terephthalate resins is used as the different type of polyester containing substantially no filament elongation enhancer, the difference in properties with respect to the polytrimethylene terephthalate resin containing the filament elongation enhancer can be adjusted as desired, therefore allowing polytrimethylene terephthalate composite yarn with excellent properties to be obtained. Also, polyethylene terephthalate has excellent properties as a clothing fiber material and can therefore be more suitably used as the polyester containing substantially no filament elongation enhancer.

These different types of polyesters may also be copolymerized with third components so long as their essential properties are not impaired, or additives commonly used for polyester fibers, such as delustering agents, may also be added thereto. Two or more of these different types of polyesters may also be used in combination as a blend if desired.

The polytrimethylene terephthalate containing the filament elongation enhancer and the different type(s) of polyester containing no filament elongation enhancer may be supplied for co-spinning and wound up at 2,000 to 8,000 m/min, such that loss of wind-up tension balance between running filament bundles due to rapid thermal stress can be avoided by the elastic recovery properties unique to polytrimethylene terephthalate, and so that it becomes possible to achieve stable production of polyester composite yarn exhibiting an excellent wound form, low alteration with time, and satisfactory properties for transport during the draw/false twisting step.

EXAMPLES

The present invention will now be explained in greater detail through the following examples. The following tests were conducted for the examples.

(1) Intrinsic Viscosity

The intrinsic viscosity of the test polytrimethylene terephthalate was measured at 35° C. using an o-chlorophenol solution as the solvent.

(2) Spinneret Treatment

The temperature of the surface of the spinneret during operation of the spinning/winding step was measured by inserting a temperature sensing pin in the surface of the spinneret to a depth of 2 mm.

(3) Cooling Air Speed Under Spinneret

The speed of the cooling air under the spinneret was determined by setting an air speed meter at a location 30 cm under the top edge of a cooling air blower nozzle with a honeycomb structure, in close contact with the honeycomb surface, and taking the average of 5 measurements of the cooling air speed.

(4) Spinning Draft

The volume speed ($cm^3$/min) of the filamentous polymer melt stream discharged from the spinneret opening was measured and divided by the discharge cross-sectional area ($cm^2$) to calculate the average polymer throughput speed (cm/min) for the discharge area, and the spinning draft of the polymer was calculated by the following equation.

Spinning draft=spinning take-up speed (cm/min)/average polymer throughput speed (cm/min) for discharge area (5) Heat Deformation Temperature (T)

The heat deformation temperature T of the test filament elongation enhancer was measured according to ASTM D-648.

(6) Measurement of Mean Particle Size (D) of Filament Elongation Enhancer

The spun test filament yarn was embedded in paraffin and cut in the direction at right angles to the filament axis into a thicknesses of 7 $\mu$m, to prepare sections for electron microscope photography (JSM-840 by JEOL), and the obtained section groups were placed on slide glass and allowed to stand in toluene for 2 days at room temperature. The treatment resulted in elution of the particulate addition polymer functioning as the filament elongation enhancer. The eluted sections were then subjected to 10 mA×2 min sputtering vapor deposition with platinum, and an electron micrograph was taken at 15,000× magnification. The cross-sectional areas of 200 filament elongation enhancer elution marks in the photographed filament cross-section were measured using an area curve meter (product of Ushikata Manufacturing Co., Ltd.), the mean particle size D of the elution marks was calculated, and the value was used to represent the mean particle size (D) of the filament elongation enhancer particles in the filament.

(7) Ratio of Average Length (L) of Filament Elongation Enhancer and (D) Above

The spun test filament was embedded in paraffin and cut along the fiber axis direction to prepare sections for electron microscope photography, and the obtained longitudinal fiber sections were placed on slide glass and allowed to stand in toluene for 2 days at room temperature. After the same treatment in (2) above, the elution marks were photographed at 15,000× magnification with an electron microscope, the lengths of 200 elution marks in the fiber axis direction were measured, the average length (L) was calculated, and the ratio of this measured L and the value of D above (L/D) was determined.

(8) Thermal Stress Peak Value

The thermal stress peak value of the test filament was measured using a thermal stress measuring device (Model KE-2) by Kanebo Engineering, Ltd. For the measurement, the initial load was 0.044 cN/dtex and the temperature elevating rate was 100° C./min. The obtained data were used to plot temperature on the horizontal axis and thermal stress on the vertical axis, in order to draw a temperature-thermal stress curve. The maximum thermal stress value was taken as the thermal stress peak value.

(9) Birefringence ($\Delta n$)

The birefringence of the test filament was measured by the following method. Specifically, the test filament was provided to a polarizing light microscope, the interference bands of the filament were measured using 1-bromonaphthalene as the penetrating solution and using monochromatic light with a wavelength of 546 nm, and $\Delta n$ was calculated by the following equation.

$$\Delta n = 546 \times (n + \theta/180)/X$$

(n: number of bands, $\theta$: compensator rotation angle, X: filament diameter)

(10) Residual Elongation

The spun test filament was allowed to stand for a day and a night in a thermo-hygrostatic chamber kept at a temperature of 25° C. and 60% humidity, and then a 100 mm long sample was set in a Tensilon tensile tester by Shimadzu Corporation and stretched at a rate of 200 mm/min, and the breaking elongation was measured.

(11) Density

The density of the test filament was measured by the density gradient tube method based on JIS-L-1013, using a density gradient tube prepared with carbon tetrachloride and n-pentane.

(12) Melt Index

The melt index of the test filament was measured according to ASTM D-1238.

(13) Number of Spun Yarn Breaks

A single-weight melt spinning machine equipped with a winding machine with two wind-up positions (2-cup winder) was operated for 24 hours, the number of yarn breaks occurring during that time were counted and the value was used as the number of spun yarn breaks, after subtracting the number of yarn breaks due to human or mechanical factors.

(14) Package Removability

The above-mentioned winder was used to wind up a prescribed weight of filament yarn to form a package. The removal resistance encountered when the package was removed from the winder was graded on the following 3 ranks.

Level 1: Smooth removal with no hindrance.

Level 2: Rather strong force required for removal.

Level 3: Removal from winder not possible.

(15) Wound Package Form

The outer appearance of a package of wound polytrimethylene terephthalate filament yarn was observed and graded on the following 3 ranks.

Level 1: Correct and orderly appearance with almost no bulging of edges and no cobwebbing of filament yarn.

Level 2: Bulging found, but without cobwebbing of filament yarn.

Level 3: Very large bulging, large swelling of edges and/or abundant cobwebbing of filament yarn.

(16) Yarn Breakage in Draw/False Twisting Step

A draw/false twisting machine (Model SDS-8, 48 weight friction disk false twisting system by Scragg Co.) was used for draw/false twisting by a method of producing two textured yarn packages from one undrawn test package, and the yarn breakage in the draw/false twisting step was calculated by the following equation.

Yarn breakage in draw/false twisting step (%)=(number of yarn breaks/48×2)×100

However, yarn breaks due to human or mechanical factors, such as yarn breaks before and after yarn knots (knot yarn breaks) or yarn breaks during automatic switching, were not counted in the number of yarn breaks.

(17) Crimp Ratio

The test false twisted yarn was subjected to a tension of 0.44 mN/dtex and wound up into a reel shape, to prepare a reel with a size of approximately 3333 dtex. The reel was subjected to a load of 1.77 mN/dtex and the length $L_0$ (cm) was measured after 1 minute. After measurement of $L_0$, the load was removed from the reel and it was treated in 100° C. boiling water for 20 minutes while under a load of 17.7 μN/dtex. After the boiling water treatment, the entire load was removed at once and the reel was allowed to dry naturally for 24 hours with no load. The naturally dried reel was then again subjected to a total load of 17.7 μN/dtex and 1.77 mN/dtex, and the length $L_1$ (cm) of the reel was measured after 1 minute. The load of 1.77 mN/dtex was removed immediately after measurement and then the length $L_2$ (cm) was measured after 1 minute and the crimp ratio was calculated by the following equation.

$$\text{Crimp ratio } (\%)=(L_1-L_2)/L_0\times 100$$

(18) Yarn Gluff in Galse Twisting Step

The test filament was continuously supplied to a Model DT-104 Fluff Counter by Toray Co., Ltd. for 20 minutes at a speed of 500 m/min to count the generation of fluff, which was represented as the number per 10,000 m of sample length.

(19) Tensile Strength and Limiting Elongation of False Twisted Yarn

The test false twisted yarn was allowed to stand for a day and a night in a thermo-hygrostatic chamber kept at a temperature of 25° C. and 60% humidity, a then 100 mm length sample was set in a tensile tester by Shimadzu Corporation (Tensilon™) and the breaking strength and elongation were measured upon tensile elongation at a speed of 200 mm/min.

(20) Feel of Fabric

The test drawn/false twisted yarn was used to prepare a twill weave fabric with a basis weight of 100 g/m$^2$, which was subjected to pre-relaxation treatment: 60° C.×30 min, relaxation treatment: 80° C.×30 min, presetting treatment: 150° C.×1 min and 20% alkali reduction treatment, after which it was dyed at a temperature of 100° C. and the dyed fabric was subjected to final setting at 160° C.×1 min. The feel of the obtained finished fabric was then evaluated. The evaluation fabric was organoleptically examined by experts and graded into the following 3 ranks.

Level 1: Suitable body and resilience, no dye spots found.

Level 2: Rather weak body and resilience, some dye spots found.

Level 3: Flat feel, conspicuous dye spots.

Example 1

A polytrimethylene terephthalate resin with an intrinsic viscosity of 1.02 containing titanium oxide at 0.3 wt % was dried at 130° C. for 6 hours. Separately, each of the filament elongation enhancers listed in Table 1 were dried to a moisture content of 40 ppm or less under reduced pressure of 0.1 Torr at the temperatures listed in Table 1. The following procedure was carried out for each of Experiment Nos. 1 to 5 listed in Table 2. That is, each of the dried filament elongation enhancers for Experiment Nos. 1 to 5 were uniformly mixed with the previously dried polytrimethylene terephthalate to the filament elongation enhancer contents listed in Table 2, to prepare polymer blends. The polymer blends were supplied to a uniaxial filament melt extruder and melted at an extruder temperature of 270° C., after which each of the melts was filtered using a metal fiber filter with a pore size of 25 μm provided directly above a spinneret, passed through the spinneret provided with discharge holes each having an aperture of 0.3 mm and a land length/aperture ratio of 2, and extruded as a filamentous polymer melt stream at a spinneret temperature of 255° C. Next, cooling air at 25° C. was blown on the filamentous polymer melt stream at a speed of 0.3 m/sec in a zone in the range of 9–100 cm below the surface of the spinneret, in a direction perpendicular to the direction of movement, for cooling and solidification, after which a spinning oil agent was applied to the solidified filament bundle through an oil feed nozzle. The filament bundle was wound up on a 124 mm-diameter, 9 mm-thick cardboard bobbin to a winding width of 90 mm, under the conditions shown in Table 2, to form a package with a yarn weight of 10 kg. The obtained polytrimethylene terephthalate yarn had a yarn count of 133 dtex/36 filaments. The spinning draft for Experiments No. 1 to No. 5 was controlled to 210 and the winding tension was controlled to 0.05 cN/dtex.

TABLE 1

| Filament elongation enhancer (abbreviation) | Filament elongation enhancer (name) | Heat deformation temperature (° C.) | Molecular weight | Melt index | Drying temperature (° C.) |
|---|---|---|---|---|---|
| 4-MP-1 | 4-Methylpentene | 30 | 3000 | 45.0 | 25 |
| 4-MP-2 | 4-Methylpentene | 45 | 8000 | 28.0 | 40 |
| PMMA-1 | Polymethyl methacrylate | 70 | 33000 | 14.0 | 65 |
| syn-PS-1 | Syndiotactic polystyrene | 85 | 50000 | 9.0 | 80 |
| PMMA-2 | Polymethyl methacrylate | 105 | 100000 | 2.1 | 100 |
| PMMA-PS | Methyl methacrylate/acrylic imide adduct/styrene copolymer | 116 | 70000 | 1.2 | 110 |

TABLE 2

| Exp. No. | Abbreviation of filament elongation enhancer used | Filament elongation enhancer content (wt %) | Spinning wind-up speed (m/min) |
|---|---|---|---|
| 1 | 4-MP-2 | 0.5 | 2000 |
| 2 | 4-MP-2 | 2 | 3500 |
| 3 | PMMA-1 | 1.5 | 6000 |
| 4 | syn-PS-1 | 2 | 5000 |
| 5 | PMMA-2 | 0.5 | 4000 |

The spun yarn breakage, package removal ease, wound form, dispersed state of the filament elongation enhancer in the polytrimethylene filament yarn and the polytrimethylene terephthalate yarn performance for each of Experiments No. 1 to No. 5 are shown in Table 3.

TABLE 3

| Exp. No. | Spun yarn breakage (times) | Package take-up ease | Wound form | Filament elongation enhancer particle size (D) ($\mu$m) | Filament elongation enhancer L/D ratio | Polytrimethylene terephthalate filament yarn: Thermal stress (cN/dtex) | Residual elongation (%) | Density (g/cm$^3$) | Bire-fringence $\Delta n$ | Elongation increase (I %) | Draw ratio increase (J %) |
|---|---|---|---|---|---|---|---|---|---|---|---|
| 1 | 0 | Level 1 | Level 1 | 0.035 | 18.2 | 0.008 | 201 | 1.312 | 0.0402 | 52 | 33 |
| 2 | 0 | Level 1 | Level 1 | 0.057 | 12.1 | 0.026 | 140 | 1.324 | 0.0434 | 75 | 47 |
| 3 | 1 | Level 1 | Level 1 | 0.061 | 7.3 | 0.097 | 90 | 1.324 | 0.0579 | 100 | 63 |
| 4 | 0 | Level 1 | Level 1 | 0.281 | 3.0 | 0.040 | 108 | 1.323 | 0.0545 | 96 | 60 |
| 5 | 0 | Level 1 | Level 1 | 0.104 | 7.4 | 0.044 | 110 | 1.322 | 0.0543 | 57 | 36 |

Next, the obtained polytrimethylene terephthalate filament yarn (10 kg package) was supplied to a draw/false twisting machine (Model SDS-8, 48 weight friction disk false twisting system by Scragg Co.), and with the temperature of the heater upstream from the false twisting unit set to 165° C., the D/Y ratio set to 1.9 (D: disk peripheral speed, Y: yarn speed) and the false twisting speed set to 400 m/min, the filament yarn was subjected to draw/false twisting at the draw ratio conditions shown in Table 4 and wound up into two 5 kg packages, to produce polytrimethylene terephthalate false twisted yarn. The draw/false twisted yarn breakage and fluff numbers are shown in Table 4.

TABLE 4

| Exp. No. | Draw ratio | Yarn breakage in draw/false twisting step (%) | Fluff in false twisted yarn (/10$^4$ m) |
|---|---|---|---|
| 1 | 2.32 | 0.8 | 1 |
| 2 | 1.85 | 1.5 | 0 |
| 3 | 1.46 | 1.3 | 0 |
| 4 | 1.60 | 2.1 | 1 |
| 5 | 1.62 | 0.5 | 0 |

Comparative Example 1

Polytrimethylene terephthalate filament yarn was produced by the melt spinning method in Example 1, for each of Experiments No. 6 to No. 10. However, the filament elongation enhancer contents and spinning wind-up speeds listed in Table 5 were used. For each of Experiments No. 6 to No. 10, the spinning draft was controlled to 210 and the wind-up tension was controlled to 0.05 cN/dtex.

TABLE 5

| Exp. No. | Abbreviation of filament elongation enhancer used | Filament elongation enhancer content (wt %) | Spinning wind-up speed (m/min) |
|---|---|---|---|
| 6 | 4-MP-1 | 2.0 | 3200 |
| 7 | PMMA-1 | 0.2 | 3500 |
| 8 | PMMA-1 | 5.0 | 4000 |
| 9 | PMMA-2 | 4.0 | 1800 |
| 10 | PMMA-PS | 2.0 | 5000 |

The spun yarn breakage, package removal ease, wound form, dispersed state of the filament elongation enhancer in the polytrimethylene terephthalate yarn and the polytrimethylene terephthalate yarn properties for each of Experiments No. 6 to No. 10 are shown in Table 6.

TABLE 6

| Exp. No. | Spun yarn breakage (times) | Package removal ease | Wound form | Filament elongation enhancer particle size (D) (μm) | Filament elongation enhancer L/D ratio | Polytrimethylene terephthalate filament yarn: Thermal stress peak value (cN/dtex) | Residual elongation (%) | Density (g/cm$^3$) | Bire-fringence Δn | Elongation increase (I %) | Draw ratio increase (J %) |
|---|---|---|---|---|---|---|---|---|---|---|---|
| 6 | 10 | Level 3 | Level 3 | 0.021 | 28.0 | 0.090 | 90 | 1.323 | 0.0579 | −6 | −4 |
| 7 | 2 | Level 3 | Level 3 | 0.048 | 10.3 | 0.110 | 97 | 1.325 | 0.0601 | 17 | 11 |
| 8 | 13 | Level 1 | Level 2 | 0.100 | 5.1 | 0.001 | 180 | 1.316 | 0.0381 | 157 | 98 |
| 9 | 16 | Level 1 | Level 3 | 0.178 | 1.8 | 0.000 | 356 | 1.305 | 0.0146 | 117 | 73 |
| 10 | 24 | Level 1 | Level 3 | 0.145 | 1.7 | 0.028 | 120 | 1.321 | 0.0511 | 140 | 88 |

The obtained polytrimethylene terephthalate filament yarn was then subjected to draw/false twisting by the same method as Example 1, to produce polytrimethylene terephthalate false twisted yarn. However, the draw ratios listed in Table 7 were used. The draw/false twisted yarn breakage and fluff numbers are shown in Table 7.

TABLE 7

| Exp. No. | Draw ratio | Yarn breakage in draw/false twisting step (%) | Fluff in false twisted yarn (/10$^4$ m) |
|---|---|---|---|
| 6 | 1.46 | 3.7 | 4 |
| 7 | 1.52 | 8.6 | 2 |
| 8 | 2.15 | 25.6 | 14 |

TABLE 7-continued

| Exp. No. | Draw ratio | Yarn breakage in draw/false twisting step (%) | Fluff in false twisted yarn (/10$^4$ m) |
|---|---|---|---|
| 9 | 3.51 | 16.8 | 27 |
| 10 | 1.69 | 12.5 | 12 |

Example 2

The two different polymers shown in Table 8 were prepared as filament elongation enhancers. Also, the two polyester resins shown in Table 9 were prepared as polyester resins containing no filament elongation enhancer.

TABLE 8

| Filament elongation enhancer (abbreviation) | Filament elongation enhancer (name) | Heat deformation temperature (° C.) | Molecular weight | Melt index | Drying temperature (° C.) | Extruder temperature (° C.) |
|---|---|---|---|---|---|---|
| syn-PS-2 | Syndiotactic polystyrene | 90 | 50000 | 9.0 | 85 | 265 |
| 4-MP-3 | 4-Methylpentene | 75 | 8000 | 28.0 | 70 | 240 |

TABLE 9

| Polyester resin containing no elongation enhancer: Polyester abbreviation | Polyester composition | Intrinsic viscosity | Drying conditions | Extruder temperature (° C.) |
|---|---|---|---|---|
| CD-PTT | Copolymerized polytrimethylene terephthalate with 1.5 mol % 5-Na sulfonic acid isophthalate | 0.90 | 150° C. × 5 hrs | 260 |
| PET | Polyethylene terephthalate | 0.64 | 160° C. × 5 hrs | 300 |

The filament elongation enhancers and polyester resins were combined in the compositional ratios shown in Table 10, and used to produce filament yarn according to the procedures described below for Experiments No. 11 and No. 12.

TABLE 10

| Exp. No. | Polyester containing no elongation enhancer | Abbreviation of filament elongation enhancer used | Filament elongation enhancer content (wt %) | Spinneret temperature (° C.) | Spinning wind-up speed (m/min) |
|---|---|---|---|---|---|
| 11 | CD-PTT | syn-PS-2 | 0.5 | 255 | 2000 |
| 12 | PET | 4-MP-3 | 2.0 | 275 | 4200 |

A polytrimethylene terephthalate resin with an intrinsic viscosity of 0.97 and a titanium oxide content of 0.3 wt % was dried at 150° C. for 5 hours, and then melted at a temperature of 260° C. in a uniaxial filament melt extruder. For Experiments No. 11 and No. 12, the filament elongation enhancers were dried under the conditions shown in Table 8 and melted with a side melt extruder linked to the above-mentioned uniaxial filament melt extruder, at the temperatures listed in Table 8, and then mixed with the above-mentioned polytrimethylene terephthalate melt to the contents listed in Table 10. The mixed melts were passed through a 12-stage static mixer for dispersion and mixing, and then passed through a metal fiber filter with a pore size of 25 $\mu$m provided directly above the spinneret and discharged at the spinneret temperatures shown in Table 10, from discharge opening group A of a spinneret having the following specifications.

Spinneret specifications: A discharge surface having 48 round discharge openings each with a discharge opening size of 0.25 mm and a land length of 0.5 mm (discharge opening group A) and 15 round discharge openings each with a discharge opening of 0.38 mm and a land length of 0.8 mm (discharge opening group B).

Separately, for both Experiment Nos. 11 and 12, the polyesters containing no filament elongation enhancer listed in Table 10 were dried under the drying conditions listed in Table 8, and then melted at the temperatures listed in Table 8 using the same type of melt extruder provided with the above-mentioned uniaxial filament melt extruder, and discharged from the above-mentioned spinneret discharge opening group B at the spinneret temperatures listed in Table 10. Next, cooling air at 25° C. was blown on a filamentous polymer melt stream adjacently discharged from discharge opening group A and discharge opening group B, at a speed of 0.2 m/sec in a zone in the range of 9–100 cm below the surface of the spinneret, and in a direction perpendicular to the direction of movement, for cooling and solidification, after which a spinning oil agent was applied to the obtained filament through an oil feed nozzle and the obtained filament group was bundled and then wound up on a 124 mm-diameter, 9 mm-thick cardboard bobbin to a winding width of 90 mm under the conditions shown in Table 10, to form a package with a weight of 6 kg. The filament yarn was a polyester composite yarn comprising a polytrimethylene terephthalate filament yarn containing the filament elongation enhancer and a polyester filament yarn containing no filament elongation enhancer. For Experiment No. 11, the spinning draft was controlled to 388 and the wind-up tension to 0.05 cN/dtex, while for Experiment No. 12, the spinning draft was controlled to 234 and the wind-up tension to 0.05 cN/dtex.

The spun yarn breakage, package removal ease, wound form, dispersed state of the filament elongation enhancer in the polytrimethylene terephthalate yarn and the polytrimethylene terephthalate yarn properties for Experiments No. 11 and No. 12 are shown in Table 11.

TABLE 11

| | Polyester composite filament yarn | | | Filament elongation enhancer | Filament | Polytrimethylene terephthalate filament yarn | | | | |
|---|---|---|---|---|---|---|---|---|---|---|
| Exp. No. | Spun yarn breakage (times) | Package removal ease | Wound form | particle size (D) ($\mu$m) | elongation enhancer L/D ratio | Thermal stress peak value (cN/dtex) | Residual elongation (%) | Density (g/cm$^3$) | Bire-fringence Δn | Elongation increase (I %) |
| 11 | 1 | Level 1 | Level 1 | 0.295 | 4.0 | 0.013 | 245 | 1.312 | 0.0157 | 85 |
| 12 | 2 | Level 1 | Level 1 | 0.054 | 17.0 | 0.025 | 212 | 1.320 | 0.0255 | 170 |

The obtained polyester composite yarn (6 kg package) was then supplied to a draw/false twisting machine (Model SDS-8, 48 weight friction disk false twisting system by Scragg Co.) and fed to an interlace nozzle provided between a supply roller and a first take-up roller at an overfeed rate of 1.5%, and then with the temperature of the heater upstream from the false twisting unit set to 140° C., the D/Y ratio set to 2.0 (D: disk peripheral speed, Y: yarn speed) and the false twisting speed set to 400 m/min, the filament yarn was subjected to draw/false twisting at the draw ratio shown in Table 12 and wound up into two 3 kg packages, to produce polyester composite false twisted yarn. The draw/false twisted yarn breakage, fluff numbers and polyester composite false twisted yarn properties for Experiments No. 11 and No. 12 are shown in Table 12.

The false twisted polyester composite yarn was used for evaluation of fabric feel by the "Feel of fabric" evaluation method described above, and the obtained results are shown in Table 12.

TABLE 12

| Exp. No. | Draw ratio | Yarn breakage in draw/false twisting step (%) | Fluff in composite false twisted yarn ($/10^4$ m) | False twisted composite yarn size | False twisted composite yarn tensile strength (cN/dtex) | False twisted composite yarn limiting elongation (cN/dtex) | Crimp ratio (%) | Fabric feel |
|---|---|---|---|---|---|---|---|---|
| 11 | 1.30 | 1.4 | 1 | 94 | 2.3 | 34.0 | 5.2 | Level 1 |
| 12 | 1.45 | 1.3 | 1 | 126 | 2.2 | 30.1 | 6.3 | Level 1 |

INDUSTRIAL APPLICABILITY

The polytrimethylene terephthalate filament yarn of the present invention exhibits improved residual elongation, excellent mechanical properties and excellent workability for draw/false twisting and the like, and such filament yarn can be efficiently produced with high productivity by the process of the invention.

What is claimed is:

1. A polytrimethylene terephthalate filament yarn comprising polytrimethylene terephthalate filaments from which a filament yarn is formed, and filament elongation enhancing agent particles dispersed and contained in the filaments, in a content of 0.5 to 4.0% by mass based on the mass of the filaments, wherein the filament elongation enhancing agent particles in the polytrimethylene terephthalate filaments satisfies the requirements (a), (b) and (c):

(a) the filament elongation enhancing agent particles have a thermal deformation temperature (T) of 40° C. or more and less than 105° C.;

(b) in cross-sectional profiles of the filaments, the filament elongation enhancing agent particles have an average particle size (D) of 0.03 to 0.35 μm; and (c) the filament elongation enhancing agent particles are drawn and oriented in the filaments along the longitudinal direction thereof and have a ratio (L/D) of the average particle length (L) of the drawn and oriented particles to the average cross-sectional size (D) of the particles of 2 to 20, and the filament yarn satisfies the requirements (d), (e), (f) and (g):

(d) the filament yarn exhibits an increase (I%) in residual elongation thereof of 30% or more, determined in accordance with the equation defining the I%:

$$I(\%)=(El_b(\%)/El_o(\%)-1)\times 100$$

in which equation, $El_b(\%)$ represents a residual elongation of the filament yarn and $El_o$ represents a residual elongation of a comparative polytrimethylene terephthalate filament yarn prepared by the same filament yarn-producing procedures as those of the filament yarn as mentioned above, except that no filament elongation enhancing agent particles are contained in the comparative filament yarn;

(e) the filament yarn exhibits a birefringence Δn of 0.02 to 0.07;

(f) the filament yarn exhibits a retaining elongation of 60 to 250%; and (g) the filament yarn exhibits a peak value in thermal stress thereof of 0.18 cN/dtex or less.

2. The polytrimethylene terephthalate filament yarn as claimed in claim 1, wherein the thermal deformation temperature (T) of the filament elongation enhancing agent particles is in the range of from 60° C. to 95° C.

3. The polytrimethylene terephthalate filament yarn as claimed in claim 1 or 2, wherein the filament elongation enhancing agent particles comprise an addition-polymerization product of at least one ethylenically unsaturated monomer which product is substantially incompatible with polytrimethylene terephthalate and has an weight average molecular weight of 2,000 or more.

4. The polytrimethylene terephthalate filament yarn as claimed in claim 3, wherein the addition polymerization product for the filament elongation enhancing agent particles is selected from the group consisting of polymethyl metacrylate polymers comprising, as at least a principal component, methyl metacrylate and isotactic polystyrene polymers comprising, as at least a principal component, styrene, and has a weight average molecular weight of 8,000 to 200,000 and a melt index A of 10 to 30 g/10 minutes determined at a temperature of 230° C. under a load of 37.3N (3.8 kgf).

5. The polytrimethylene terephthalate filament yarn as claimed in claim 3, wherein the addition polymerization product for the filament elongation enhancing agent particles is selected from syndiotactic polystyrene polymers comprising, as at least a principal component, styrene, and has a weight average molecular weight of 8,000 to 200,000 and a melt index B of 6 to 50 g/10 minutes determined at a temperature at 300° C. under a load of 21.2N (2.16 kgf).

6. The polytrimethylene terephthalate filament yarn as claimed in claim 3, wherein the addition polymerization product for the filament elongation enhancing agent particles is selected from polymethylpentene polymers comprising as at least a principal component, methylpentene-1, and has a weight average molecular weight of 8,000 to 200,000 and a melt index C of 26 to 20 g/10 minutes determined at a temperature of 260° C. under a load of 49.0N (5.0 kgf).

7. The polytrimethylene terephthalate filament yarn as claimed in claim 1, further comprising polyester filaments containing substantially no filament elongation enhancing agent particles and mixed into the polytrimethylene terephthalate filaments.

8. The polytrimethylene terephthalate filament yarn as claimed in claim 7, wherein the polyester filaments containing substantially no filament elongation enhancing agent particles comprise a polyester selected from the group consisting of trimethylene terephthalate, polyethylene terephthalate, polybutylene terephthalate, poly-1,4-cyclohexanedimethylene terephthalate, and polyethylene-2,6-naphthalenedicarboxylate.

9. A process for producing a polytrimethylene terephthalate yarn comprising:

mixing a polytrimethylene terephthalate resin with a filament elongation enhancing agent particles having a thermal deformation temperature of 40 to 105° C. in an amount of 0.5 to 4.0% by mass based on the mass of the resin;

melting the resultant resin mixture, extruding the melt through a melt-spinneret into the form of filaments, cool-solidifying the extruded filamentary melt streams under draft along a melt-spinning line, and winding up the solidified filaments at a speed of 2,000 to 8,000 m/min, wherein the melt of the resin mixture is passed through a filter arranged right above the melt spinneret in the melt spinning line and having a pore size of 40 $\mu$m or less;

and the melt-spinning draft is controlled in the range of from 150 to 800.

10. The process for producing a polytrimethylene terephthalate yarn as claimed in claim 9, wherein the temperature of the melt spinneret is controlled in the range of from 240 to 270° C., the cool-solidifying is effected by blowing cooling air toward the extruded filamentary melt streams at a blow speed of 0.1 to 0.4 m/second, and the winding is effected under a winding tension of 0.035 to 0.088 cN/dtex.

11. The process for producing a polytrimethylene terephthalate yarn as claimed in claim 9, further comprising in the melt-extruding procedures, co-melt extruding the polytrimethylene terephthalate resin containing the filament elongation enhancing agent particles and a polyester resin containing substantially no filament elongation enhancing agent particles in accordance with a co-melt spinning method through one and the same spinneret or two spinnerets different from each other; and in the winding procedure, combining the resultant polytrimethylene terephthalate filaments with the co-melt spun polyester filaments while the combined filament yarn is wound at a speed of 2,000 to 8,000 m/second.

12. The process for producing a polytrimethylene terephthalate yarn as claimed in claim 11, wherein the polyester filaments containing substantially no filament elongation enhancing agent particles comprise a polyester selected from the group consisting of trimethylene terephthalate, polyethylene terephthalate, polybutylene terephthalate, poly-1,4-cyclohexanedimethylene terephthalate, and polyethylene-2,6-naphthalenedicarboxylate.

* * * * *